United States Patent [19]

Grum-Schwensen

[11] Patent Number: 5,072,777

[45] Date of Patent: Dec. 17, 1991

[54] PRESS FOR PRESSING OF MOLDS

[75] Inventor: Jens C. Grum-Schwensen, Frederikssund, Denmark

[73] Assignee: Dansk Industri Syndikat A/S, Herlev, Denmark

[21] Appl. No.: 545,074

[22] Filed: Jun. 29, 1990

[30] Foreign Application Priority Data

Jul. 6, 1989 [DK] Denmark ..... 3358/89

[51] Int. Cl.[5] ..... B22C 11/10; B22C 15/08

[52] U.S. Cl. ..... 164/207; 164/187

[58] Field of Search ..... 164/207, 187, 182, 227, 164/169, 40, 37

[56] References Cited

U.S. PATENT DOCUMENTS 3,760,866 9/1973 Larkin ..... 164/207 X
4,537,238 8/1985 Achinger et al. ..... 164/169
4,890,664 1/1990 Hunter ..... 164/182

FOREIGN PATENT DOCUMENTS 1583526 2/1971 Fed. Rep. of Germany .
47-19507 6/1972 Japan ..... 164/169

*Primary Examiner*—J. Reed Batten, Jr.
*Attorney, Agent, or Firm*—Larson & Taylor

[57] ABSTRACT

A press in which a mold carrier (17) is moved into and out of the press on rails includes a pattern carrier trolley (8) which runs on rails (21). The pattern carrier (17) is releasably placed on the pattern carrier trolley. In this manner, the motor (22,23) by which the pattern carrier (17) is moved into and out of the press and the ejector (10) by which the finished molds are ejected from the press can be permanently connected with the trolley (8).

13 Claims, 2 Drawing Sheets

PRESS FOR PRESSING OF MOLDS

The present invention relates to a press for pressing mold parts which includes a pattern placing means including a trolley on rails and an ejector fastened to the trolley.

In the case of previously known presses of this type, the means for placing a molding pattern opposite the open sides of the single press chambers has consisted of a pattern carrier in the form of a trolley with its own wheels. The wheels are adapted for rolling into and out of the press stand on rails. One set of rails was fastened to and placed in the press stand, whereas another set of rails was one of several sets on a turret. Turning of the turret could make one of its sets of rails to be in line with the set of rails of the stand in such a way that a pattern carrier could roll from the turret into the press or the opposite.

With this known embodiment problems would arise in many cases. One main problem was with an ejector, with which the last produced mold was to be ejected from the press, and which should at pattern changes be disconnected or connected with each single pattern carrier. The connection was made even more complicated because this ejector should also be movable in other directions besides the direction of the ejection. In addition, with a machine of this type, separate means are required for ensuring accurate alignment of the "interior" and the "exterior" rails. In addition, the means of moving by which the pattern carrier was moved into and out of the press should be coupled with, and respectively disconnected from, the single pattern carrier.

The object of the present invention is to provide a press which does not suffer from the drawbacks mentioned above. This object is achieved by a press, which according to the present invention displays the features set forth above. In this way the trolley functions are, so to speak, removed from the pattern carriers and transferred to a single slide or trolley. This slide or trolley is permanently connected to the press, and in this manner it is therefore possible to obtain a permanent connection with the ejector mentioned as well as with the moving organs also mentioned.

Suitable embodiments of the press according to the present invention and the respective consequences are explained in the following description.

The present invention also relates to a pattern carrier for use with a press according to the invention. According to the invention, this pattern carrier is characterized by the embodiment set forth hereinafter.

Figure 1:
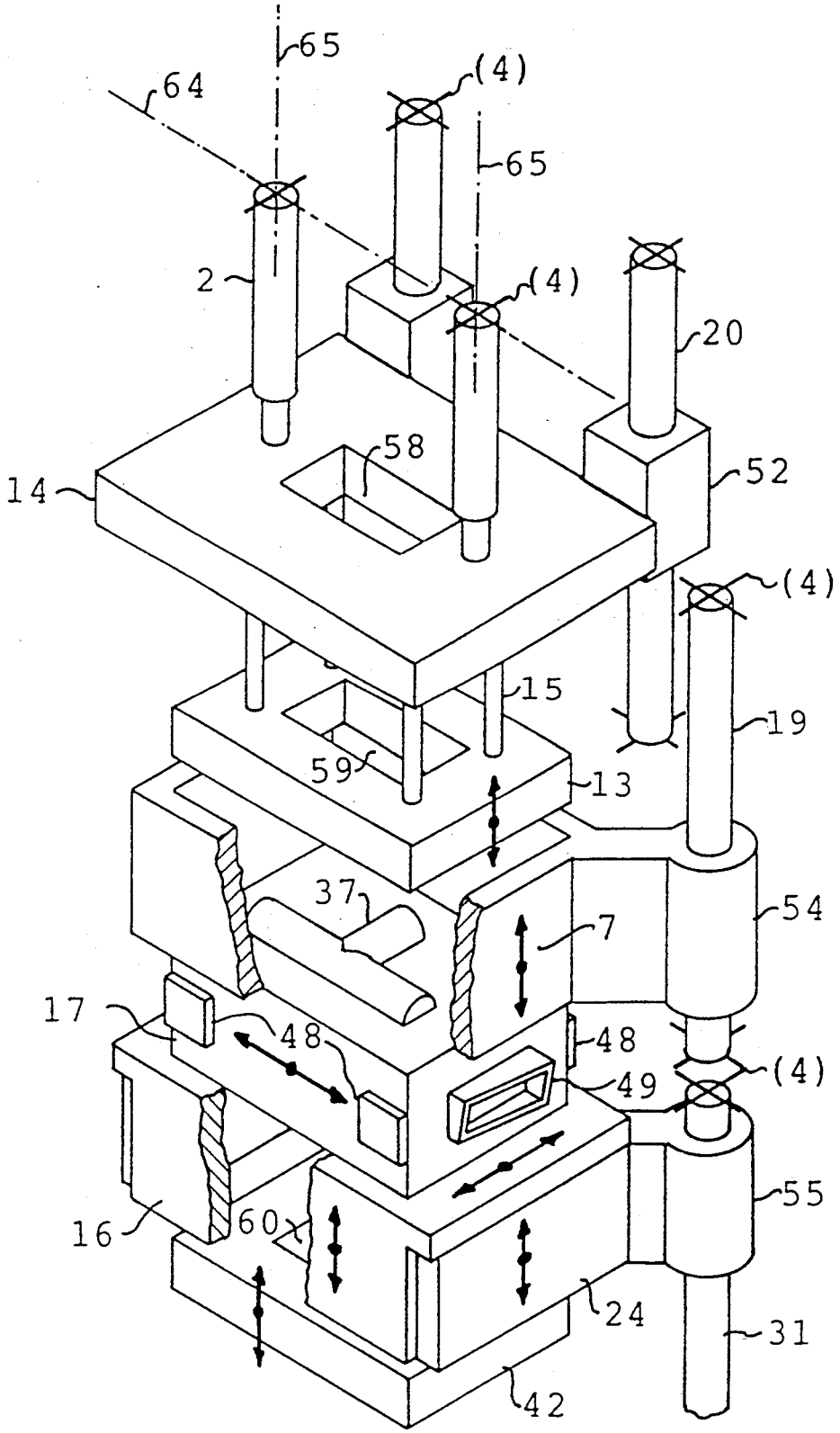
Figures 2, 3:
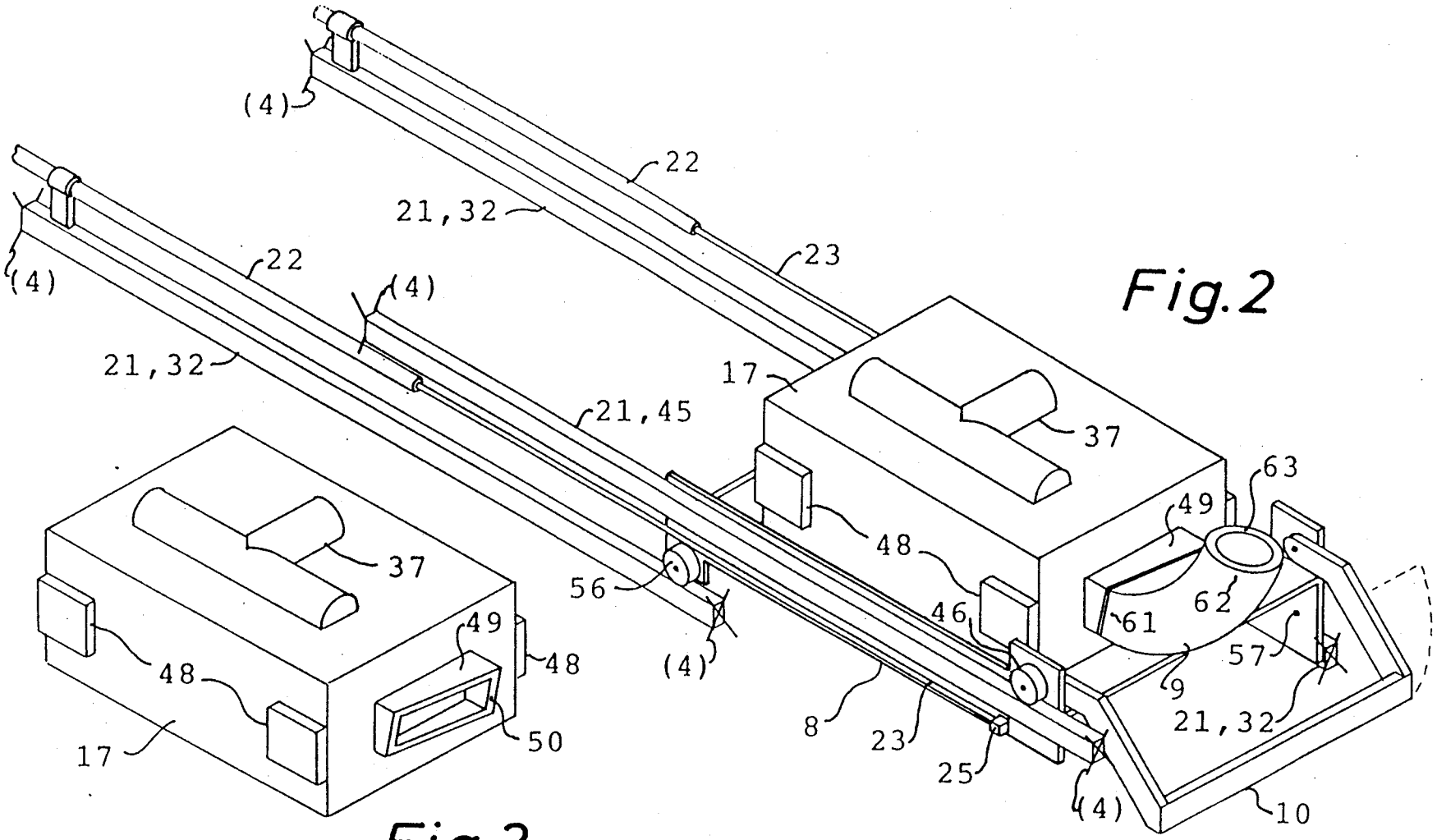

The invention will be explained in more detail in the following, with reference to the exemplary embodiments shown in the drawings of the parts of a press according to the invention that are important for the invention, in that FIG. 1 shows the parts that are primarily active during the pressing operation proper, and FIG. 2 shows the means by which the pattern carrier is moved in and out of the press, and FIG. 3 shows the pattern carrier itself.

For the sake of good order it should be noted that the drawings are highly simplified, with a large number of details of the actual press have been left out because they would have made the drawings less clear. It should also be noted that FIGS. 2 and 3 show the parts on a scale which is about one third larger than the scale used in FIG. 1.

The exemplary embodiment of a press according to the invention illustrated in the drawing comprises a stand 4 (not shown in detail in the drawing, but sketched by means of a row of crosses), showing that the means in question are fastened to the stand in the places indicated. The stand may be of any suitable type that will absorb the forces occurring during the pressing and the related process stages. Preferably, the stand consists of a relatively sturdy "ridge" which can be imagined in FIG. 1 as placed on the rear side (i.e. the side of the means shown here facing upwards and to the right), as well as means that absorb tensile stresses and which are placed on the front side (i.e. the side which in FIG. 1 faces downwards and to the left). Professionals in this field will know how such a press stand can be designed and built.

The pressing means shown in FIG. 1 are intended for simultaneous pressing of two mold parts, namely an upper mold part (which is formed in an upper press chamber 7 by compression of molding sand between an upper press plate 13 and the top side of a pattern carrier 17, on which for this purpose are placed an upper pattern 37), and a lower press chamber 16 (where the pressing takes place in a similar manner between the lower press plate 42 and the bottom side of the pattern carrier 17, to which a lower pattern (not shown) is fastened).

In the work position of the pattern carrier 17 shown in FIG. 1, the carrier 17 is supported by guide blocks 48, which project from the side of the pattern carrier 17 and engage corresponding, horizontal guides (not shown) in the press stand 4.

The upper press plate 13 is connected to an upper press frame 14 through a number of press plate legs 15, which are relatively thin and therefore transfer only relatively slight lateral forces from the upper press plate 13 to the upper press frame 14.

The upper press frame 14 is disposed horizontally and slides vertically by means of guide slides 52 on a pair of press frame guides 20, which at the ends are fastened to the stand 4. The lower press plate 42 is in a similar manner connected with a lower press frame (not shown), which again is disposed vertically and slides on vertical guides (not shown), which are fastened to the stand 4 in a similar manner as the guides 20.

For the purpose of making it possible to place the pattern carrier 17 with its attached patterns in correct position before each pressing sequence, and to make it possible to remove the upper and lower mold parts (not shown) produced by the pressing, the upper press chamber 7 and the lower press chamber 16 by means of respective guide slides 54, 55, are disposed vertically and slidingly on a set of upper chamber guides 19 and a set of lower chamber guides or auxiliary chamber guides 31, respectively. The chamber guides 19 and 31, of which only a single guide of each set is shown in the drawing, are fastened at the end to the stand 4. It should be noted here that the press frame guides, of which only the upper ones are shown, namely the guides 20, and the chamber guides 19 and 31 are fastened to the stand independently of each other, so that any stresses that one or a set of these guides might be subjected to are not transferred to the others.

In addition, the lower press chamber 16 is in contrast to the upper press chamber 7 adapted to be withdrawn and exchanged or repositioned, as it is disposed horizontally and slidingly on an auxiliary frame 24, which forms the connection to the guide slides 55. The lower press chamber 16 can also be adapted to be moved horizontally by other means, for example by a turret or similar structure. The purpose of the possibility of withdrawing it is only to make it possible to set cores in the top side of the lower mold part, which has been formed by pressing against the bottom side of the pattern carrier 17 and the pattern fastened to it.

Before and possibly during the pressing operation itself, molding sand or other suitable molding material must be supplied to the interior of the press chambers 7 and 16. This may be done for example by means of suitable channel means, which may pass through openings 58,59 and 60 in the upper press frame 14, the upper press plate 13, and the lower press plate 42, respectively, and a corresponding opening in the lower press frame (not shown). The molding sand can be supplied by means of compressed air in the sand tank (not shown) and/or by means of a vacuum, which may be applied for instance to the interior of the press chambers 7 and 16 through openings (not shown) on the top side and the bottom side, respectively of the pattern carrier 17, which openings for this purpose are connected to a vacuum connector 49 whose mode of operation is explained in the following.

During pressing it is essential that the press chambers 7 and 16 should be placed exactly correct in relation to the pattern carrier 17, as the mold parts formed at the pressing will otherwise be unsuitable for pouring in an automatic foundry plant. However, an oblique thrust load of the press plates 13 and 42 may arise, especially if the patterns used are in some manner assymmetric in relation to the symmetry planes of the press. This load will of course be transferred to the press frame guides 20 etc., so that these will be deformed corresponding to the oblique load.

Since the press frame guides 20 etc. are fastened directly to the press stand 4 independently of the chamber guides 19 and 31, these deformations will not be transferred to the press chambers 7 and 16, which will therefore be held in position by its related guides 19 and 31 without interference.

In the case of an oblique load of the type mentioned above, a horizontal component in the reactive force on the press plates 13 and 42 may also occur. In order to ensure that this horizontal component (which is transferred to the matching press frames, guide slides and guides) is insignificant, the press plate legs 15 etc. connecting the press plates with the press frames are adapted, dimensioned and positioned in such a manner that in the case of lateral stresses they will yield elastically and cause a transfer of only relatively small lateral forces to the relevant press chamber. However, the legs do not yield significantly in the longitudinal direction, for which reason the side of the mold part facing the press plate will assume the requisite orientation in relation to the concerned side of the pattern carrier 17 and—not least—the matching press chamber.

FIGS. 2 and 3 explain how the pattern carrier 17 can be moved to and from the work position shown in FIG. 1.

The pattern carrier 17 is placed in a releasable manner in a pattern carrier trolley 8, which by means of four wheels (two of which, designated 46 and 56, can be seen in FIG. 2) can roll into and out of the press on a set of rails collectively designated 21. As indicated by a number of crosses, the set of rails 21 is fastened in the press stand 4. The pattern carrier trolley 8 can be moved to and from the work position shown in FIG. 1—and incidentally also in FIG. 2—by means of two thrusters 22 whose cylinder part is fastened to the press stand 4 and whose piston rods 23 are fastened to the pattern carrier trolley 8 by means of fastening blocks 25.

By means of precision supporting means (not shown), the pattern carrier 17 is adapted to be releasably mounted in the pattern carrier trolley 8, so that the pattern carrier may be taken out for the purpose of changing patterns, maintenance, or cleaning.

The pattern carrier trolley 8 is adapted as an open frame. Thus, the pattern carrier 17 can co-operate with the upper press chamber 7 and the upper press plate 13 shown in FIG. 1 with its top side and the pattern 37 placed there. In addition, with its bottom side and the pattern fastened there, it can also co-operate with the lower press chamber 16 and the lower press plate 42 also shown in FIG. 1.

On the pattern carrier trolley 8, a vacuum adapter piece 9 is attached. At one of its ends 61, vacuum adapter piece 9 has a coupling face (not visible in FIG. 2) adapted to engage fluid-tight with a coupling face 50, cf. FIG. 3, on the vacuum connector 49 on the pattern carrier 17. At its other end 62, vacuum adapter piece 9 has a coupling face 63 which is adapted to engage fluid-tight with a matching coupling face on a vacuum tube (not shown), which is fastened to the stand 4.

The coupling face 50—and of course also the matching coupling face on the vacuum adapter—is not at right angles to the direction of movement of the pattern carrier 17, but is placed obliquely to this both in the vertical and the horizontal plane. Hereby it is achieved that the fluid-tight engagement between the coupling faces can be ensured without horizontal movement of the pattern carrier 17 in relation to the pattern carrier trolley 8, a fact that is important when the pattern carrier 17 is to be guided on the pattern carrier trolley 8 by means of vertically placed guide pins or similar (not shown). This effect is obviously achieved principally due to the obliqueness in the vertical plane. The obliqueness in the horizontal plane facilitates the introduction of the pattern carrier 17 in a position above its final position on the pattern carrier trolley, when this takes place by means of a turret or similar, on which the pattern carrier is provisionally fastened in a non-radial direction.

After pressing the two mold parts in the upper press chamber 7 and the lower press chamber 16, the press chambers are moved from each other while taking along the mold parts. Whereupon the pattern carrier 17 is by means of the pattern carrier trolley 8 moved to a position (not shown) outside the pressing means by means of the thrusters 22. Then the two mold parts are moved together, possibly after cores have been set, for forming a mold, which is then to be moved out of the press to a pouring station (not shown).

In order allow the pattern carrier trolley to push the produced mold out of the press onto a suitable, table or similar (not shown), the trolley is at the end (shown to the right in FIG. 2) equipped with a pusher 10. In the lowered position shown in FIG. 2, pusher 10 is placed near the surface level of the said table, so that it can push the mold out from the press with minimum stress on the mold. In order to avoid during the opposite directed movement of the pattern carrier trolley 8 that the pusher 10 should damage the lower mold part just made, and especially "green cores" sticking up from it, the pusher 10 is pivotally suspended on the pattern carrier trolley 8 and adapted by means of a truster or similar (not shown) to be raised from the lowered position shown in FIG. 2. Obviously, the raising and lowering of the pusher 10 will take place automatically in accordance of the movement of the pattern carrier trolley 8.

As it can be seen in FIG. 1, the lower press chamber 16 is slidingly suspended on the auxiliary frame 24, as mentioned above for the purpose of setting cores. During the movements required for this it is important that parts belonging to the press stand 4 should not be in the way of the cores, which may project some distance above the top side of the press chamber 16.

In order to avoid that any part of the set of rails 21 on which the pattern carrier trolley runs should be in the way of these cores, the set of rails 21 is sectioned. These section include two relatively low-placed rails 32, one of which, shown at the top in FIG. 2, is longer than the other, and a relatively high-placed rail 45. To match this arrangement, the pattern carrier trolley 8 is equipped with a set of relatively low-placed wheels (of which only one 56 is seen, whereas the journal 57 for one of the others can be seen to the right in FIG. 2), and a relatively high-placed wheel 46. The relatively low- and high-placed wheels rolling on the low- and high-placed rails, as shown in FIG. 2. To avoid the pattern carrier trolley 8 standing in the way of the cores mentioned, the part of the trolley 8 supported by the high-placed wheel 46 is raised some distance above the other parts of the trolley.

It will be obvious that the rail set 21 and the wheels 46,56 will be unable to support the forces acting on the pattern carrier 17 during the actual pressing operation. The pattern carrier 17 is therefore provided with a number of guide blocks 48 projecting to the side and adapted to be supported by corresponding horizontal guides (not shown) in the stand 4. During the movement away from and into the work position shown in FIGS. 1 and 2, however, the pattern carrier 17 is only supported by the pattern carrier trolley 8 and the rail set 21. But as in such a situation no pressing force is exerted on the pattern carrier 17, this does not cause any problems.

As it appears from FIG. 1, the guides 20,19 and 31 shown are adapted as round rods or pipes. This is preferable at the moment for production reasons, because it is relatively simple to adapt the requisite sliding surfaces as sectionally circular borings in the guide slides 52,54, respectively 55. However, the effect of the separate guiding of the press plates on one side and the press chamber on the other, and of the separation of the guides in the upper and the lower parts of the press, does not depend on such an adaptation of the guides which may, for example, be also be square or dovetailed in an otherwise known manner.

The exemplary embodiment shown comprises "double-acting" pressing, i.e. simultaneous pressing of an upper part and a lower part for a mold. But the equipment shown and described can also be adapted to "single-acting" pressing, i.e. pressing of only one upper mold part or only one lower mold part.

In the foregoing the pressing operation itself has also been described as mainly mechanical, and the embodiment of the parts shown in FIG. 1 are therefore based on pressing of that type. However, the principles illustrated by means of FIGS. 2 and 3 can also be applied on presses where the pressing is carried out in another manner than the one shown, as it will be known in the foundry technology.

In the example shown in FIG. 1 the pressing power is generated on the press plates 13 and 42 generated by means of the press plate cylinders adapted for that purpose (of which the uppermost, designated with 2, is shown). These press plate cylinders are obviously fastened to the stand 4 (not shown). As mentioned above, the press stand 4 can be adapted with a "ridge" placed behind the guides 20,19 and 31, (i.e. in FIG. 1 above and to the right of these), whereas the stand has at the front of the parts shown a means of transmitting tensile stress, for example a tie rod connecting the upper and lower parts of the stand, preferably through jibs adapted for that purpose. Through suitable dimensioning and positioning of the "ridge", the tie rod and the jibs, it can be achieved that while influenced by the pressing forces and thrust from the mold parts, the stand is not subjected to any significant deflection in the symmetry plane of the press plate, which in FIG. 1 is suggested by the dot-and-dash lines 64 and 65, or other planes containing the direction of pressing. In this manner it is avoided the the thrust absorbed by the stand should deform it in such a manner as to disturb the mutual alignment of the press plates, the press chambers, and the pattern carrier.

I claim:

1. A press for pressing mold parts comprising:

(a) a press stand (4), (b) at least one press chamber (7,16,13,42) with an open side which is slidingly supported in the press stand (4), (c) means for filling mold material into each said press chamber, (d) means for pressing the mold material filled into each press chamber against a pattern, (e) means for placing the pattern (37,-) opposite the open side of each press chamber, said placing means comprising i) a set of rails (21) fastened in the stand (4), ii) an associated trolley (8) movably supported on the rails, said trolley being adapted for releasable take-up of a pattern carrier (17) for the pattern (37,-) and iii) a motor means (22,23) for moving the trolley (8) on said rails between a working position in which the pattern carrier (17) is held in a position where the pattern is held opposite to the open side of the associated press chamber (7,16,13,42) and a pattern changing position in which the pattern carrier (17) is replaceable in the trolley (8), and (f) an ejector (10) for ejecting pressed mold parts or finished molds from said press chamber, the ejector (10) being fastened to an end of the trolley (8) that is furthest removed from the area where the pattern carrier (17) is placed when the trolley (8) is placed in the pattern changing position mentioned.

2. A press according to claim 1 wherein the ejector (10) is moved between a lowered position where a lower edge thereof is principally at a first level which is at the same level as a surface on which the molds which are ready for ejection after the pressing are resting, and a raised position in which the lower edge is at a higher level than the first level.

3. A press according to claim 12 wherein said pattern carrier includes at least one first fluid coupling part (49); and wherein the trolley (8) is provided with at least one fluid coupling adaptor (9), said adaptor having a first end (61) which can be connected releasably with said at least one first fluid coupling part (49) of said pattern carrier and an opposite end (62) which is, in the working position of the trolley (8), connected with at least one other fluid coupling part attached to the stand (4).

4. A press according to claim 2 wherein said pattern carrier includes at least one first fluid coupling part (49); and wherein the trolley (8) is provided with at least one fluid coupling adaptor (9), said adaptor having a first end (61) which can be connected releasably with said at least one first fluid coupling part (49) of said pattern carrier and an opposite end (62) which is, in the working position of the trolley (8), connected with at least one other fluid coupling part attached to the stand (4).

5. A press according to claim 3 wherein said at least one fluid coupling part (49) of said pattern carrier and said mating first end 61 of said at least one fluid coupling adaptor are in sealing contact and include mating faces (50,61) which are vertically oblique relative to a plane which is normal to the direction of movement of said pattern carrier between the working position and the pattern changing position.

6. A press according to claim 4 wherein said at least one fluid coupling part (49) of said pattern carrier and said mating first end 61 of said at least one fluid coupling adaptor are in sealing contact and include mating faces (50,61) which are vertically oblique relative to a plane which is normal to the direction of movement of said pattern carrier between the working position and the pattern changing position.

7. A press according to claim 5 wherein said at least one fluid coupling part (49) of said pattern carrier and said mating first end 61 of said at least one fluid coupling adaptor include mating faces (50,61) which are horizontally oblique relative to a the plane which is normal to the direction of movement of said pattern carrier between the working position and the pattern changing position.

8. A press according to claim 6 wherein said at least one fluid coupling part (49) of said pattern carrier and said mating first end 61 of said at least one fluid coupling adaptor include mating faces (50,61) which are horizontally oblique relative to a the plane which is normal to the direction of movement of said pattern carrier between the working position and the pattern changing position.

9. A press for pressing mold parts comprising:

(a) a press stand (4), (b) upper and lower press chambers (7,16,13,42) each with an open side facing downwards and upwards, respectively, said press chambers being slidingly supported in the press stand (4), (c) means for filling mold material into each said press chamber, (d) means for pressing the mold material filled into each said press chamber against a pattern, (e) means for moving at least a chamber part of said lower press chamber in a horizontal direction after pressing of the mold material, and (f) means for placing the pattern (37,-) opposite the open side of each press chamber, said placing means comprising i) a set of rails (21) fastened in the stand (4), each said rail including at least first and second rail parts with said first rail part located adjacent said lower press chamber and situated at a higher level than said second rail part whereby said chamber part of said lower press chamber is movable past said first rail part, ii) an associated trolley (8) movably supported on the rails by associated first and second sliding mechanisms which are at different levels so as to cooperate with respective said first and second rail parts, said trolley being adapted for releasable take-up of a pattern carrier (17) for the patterns (37,-) and having an open frame with a frame opening of such a size and a distance between said rails that the pattern associated with said lower press chamber is fastened to a lower side of said pattern carrier (17) so as to cooperated freely with said lower press chamber (16,42) and iii) a motor means (22,23) for moving the trolley (8) on said rails between a working position in which the pattern carrier (17) is held in a position where the pattern is held opposite to the open side of the associated press chamber (7,16,13,42) and a pattern changing position in which the pattern carrier (17) is replaceable in the trolley (8).

10. A press for pressing mold parts comprising:

(a) a press stand (4), (b) at least one press chamber (7,16,13,42) with an open side which is slidingly supported in the press stand (4), (c) means for filling mold material into each said press chamber, (d) means for pressing the mold material filled into each press chamber against a pattern, (e) means for placing the pattern (37,-) opposite the open side of each press chamber, said placing means comprising i) a set of rails (21) fastened in the stand (4), ii) an associated trolley (8) movably supported on the rails, said trolley being adapted for releasable take-up of a pattern carrier (17) for the pattern (37,-) and iii) a motor means (22,23) for moving the trolley (8) on said rails between a working position in which the pattern carrier (17) is held in a position where the pattern is held opposite to the open side of the associated press chamber (7,16,13,42) and a pattern changing position in which the pattern carrier (17) is replaceable in the trolley (8), and (f) wherein said press stand (4) is provided with horizontal guides and said pattern carrier (17) is provided with associated guide blocks (48) which are received by said guides so that during the pressing operation and related operations vertical forces exerted on said pattern and thereby on said pattern carrier are essentially transmitted only to said stand (4) through said guides and guide blocks (48).

11. A press according to claim 10 wherein said guide blocks (48) are located on sides of said pattern carrier.

12. A press according to claim 11 wherein said pattern carrier includes at least one first fluid coupling part (49); and wherein the trolley (8) is provided with at least one fluid coupling adaptor (9), said adaptor having a first end (61) which can be connected releasably with said at least one first fluid coupling part (49) of said pattern carrier and an opposite end (62) which is, in the working position of the trolley (8), connected with at least one other fluid coupling part attached to the stand (4).

13. A press for pressing mold parts comprising:

(a) a press stand (4), (b) at least one press chamber (7,16,13,42) with an open side which is slidingly supported in the press stand (4), (c) means for filling mold material into each said press chamber, (d) means for pressing the mold material filled into each press chamber against a pattern, (e) means for placing the pattern (37,-) opposite the open side of each press chamber, said placing means comprising i) a set of rails (21) fastened in the stand (4), ii) an associated trolley (8) movably supported on the rails, said trolley being adapted for releasable take-up of a pattern carrier (17) for the pattern (37,-) and iii) a motor means (22,23) for moving the trolley (8) on said rails between a working position in which the pattern carrier (17) is held in a position where the pattern is held opposite to the open side of the associated press chamber (7,16,13,42) and a pattern changing position in which the pattern carrier (17) is replaceable in the trolley (8), (f) wherein said pattern carrier includes at least one first fluid coupling part (49), and (g) wherein the trolley (8) is provided with at least one fluid coupling adaptor (9), said adaptor having a first end (61) which can be connected releasably with said at least one first fluid coupling part (49) of said pattern carrier and an opposite end (62) which is, in the working position of the trolley (8), connected with at least one other fluid coupling part attached to the stand (4).

* * * * *